US007728792B2

(12) United States Patent
Sawa et al.

(10) Patent No.: US 7,728,792 B2
(45) Date of Patent: Jun. 1, 2010

(54) MESH-PATTERN PARTITIONED PLASMA DISPLAY PANEL

(75) Inventors: Masahiro Sawa, Kawasaki (JP); Yoshimi Kawanami, Kawasaki (JP); Koji Ohira, Kawasaki (JP); Nobuyuki Takahashi, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 526 days.

(21) Appl. No.: 11/745,582

(22) Filed: May 8, 2007

(65) Prior Publication Data

US 2007/0285348 A1 Dec. 13, 2007

Related U.S. Application Data

(63) Continuation of application No. 10/838,352, filed on May 5, 2004, now Pat. No. 7,233,107.

(30) Foreign Application Priority Data

Jul. 1, 2003 (JP) ..... 2003-189715

(51) Int. Cl.
*G09G 3/28* (2006.01)
*H01J 17/49* (2006.01)

(52) U.S. Cl. ..... 345/66; 345/60; 313/585; 313/610

(58) Field of Classification Search ..... 345/60–86, 345/204–214; 315/169.3, 169.4; 313/567–643
See application file for complete search history.

(56) References Cited

U.S. PATENT DOCUMENTS 6,608,441 B2 * 8/2003 Kunii et al. ..... 313/585
6,674,238 B2 1/2004 Otani et al.
6,856,305 B2 2/2005 Nagano
6,876,340 B2 * 4/2005 Kobayashi ..... 345/60

(Continued)

FOREIGN PATENT DOCUMENTS

CN 1397979 2/2003

(Continued)

OTHER PUBLICATIONS

European Search Report issued on Mar. 13, 2009 in corresponding European Patent Application 04252716.8.

*Primary Examiner*—David L Lewis
(74) *Attorney, Agent, or Firm*—Staas & Halsey LLP

(57) ABSTRACT

A plasma display panel is provided in which discharge connection in the column direction is prevented without increasing the number of man-hours in a formation process of a partition and without deteriorating ventilation for an exhaust process. A pattern in a plan view of a partition is made a mesh pattern in which vertical patterns are included at inter-row positions in each column. Each of first vertical walls is positioned at a boundary between columns, each of second vertical walls is arranged at a position away from a boundary between columns for each boundary between rows and each of horizontal walls is positioned at a boundary between rows. In the partition, a height of portions where the first vertical wall crosses the horizontal wall and a height of portions where the second vertical wall crosses the horizontal wall are smaller than a height of the other portions of the partition.

6 Claims, 6 Drawing Sheets

U.S. PATENT DOCUMENTS

| | | | | |
|---|---|---|---|---|
| 7,233,107 | B2 * | 6/2007 | Sawa et al. | 313/585 |
| 2002/0047519 | A1 | 4/2002 | Kunii et al. | |
| 2003/0080682 | A1 | 5/2003 | Nagano | |
| 2004/0085264 | A1 | 5/2004 | Takada et al. | |
| 2007/0075640 | A1 | 4/2007 | Takada et al. | |

FOREIGN PATENT DOCUMENTS

| | | | |
|---|---|---|---|
| CN | 1414596 | | 4/2003 |
| EP | 1 276 131 | A2 | 1/2003 |
| JP | 5-166467 | | 7/1993 |
| JP | 2002-83545 | | 3/2002 |
| JP | 2002-190256 | | 7/2002 |
| KR | 2001-0099573 | | 11/2001 |
| WO | 02/31852 | A1 | 4/2002 |

* cited by examiner

MESH-PATTERN PARTITIONED PLASMA DISPLAY PANEL

CROSS-REFERENCE TO RELATED APPLICATIONS

This application is a Continuation of application Ser. No. 10/838,352 filed May 5, 2004 now U.S. Pat. No. 7,233,107, now allowed, and which claims the benefit of Japanese Patent Application No. 2003-189715 filed Jul. 1, 2003.

BACKGROUND OF THE INVENTION

1. Field of the Invention

The present invention relates to a plasma display panel (PDP) having a mesh-patterned partition for dividing a screen into cells arranged in each row and each column of a matrix display.

In recent years, a mesh-patterned partition that offers advantages in separation of discharges and increase in arrangement area of fluorescent materials has drawn attention instead of a stripe-patterned partition that is excellent in mass productivity. In the case of adoption of the mesh-patterned partition, it is desirable to contrive so as to shorten a time required for an exhaust process in manufacture of a plasma display panel.

2. Description of the Related Art

In manufacturing a plasma display panel, a pair of substrates is attached to each other, then, an interior space is cleaned to perform an exhaust process for filling a discharge gas. A gas remained in a gap between the substrates is evacuated through a vent formed on the back substrate to produce a vacuum, and after that, a discharge gas is filled.

Concerning acceleration of an exhaust process in a mesh-patterned partition, U.S. Pat. No. 6,608,441 discloses that a partition is partly lowered to provide a mesh-like air path passing through all cells in a screen. The mesh-like air path has better ventilation than a unidirectional air path has, such as a vertical air path or a horizontal air path.

A heat shrink property of a partition material is used in formation of a partition, and thereby, a partition that is partially low can be formed by the same man-hour as the case of forming a partition having a constant height. More specifically, when a partition is formed by baking a low melting point glass paste, a pattern width of a portion to be lowered in a mesh pattern is thickened. Since shrinkage in the width direction is inhibited in the thick portion, the shrinkage amount in the height direction of the thick portion is greater than that of a thin portion by the corresponding amount. Accordingly, a portion whose pattern width is thickened is lower than the other portions in the partition.

According to a plasma display panel described in U.S. Pat. No. 6,608,441 mentioned above, since portions corresponding to inter-row portions in a matrix display of a partition are equally low, there is a problem that separation of discharges among cells constituting columns of the matrix display tends to be insufficient. Especially, in a high-definition plasma display panel in which display electrodes are arranged between rows, a discharge tends to extend in the column direction (generally, in the vertical direction) through the display electrodes each of which straddles adjacent two rows. Accordingly, it is necessary to ensure discharge separation between rows.

SUMMARY OF THE INVENTION

The present invention is directed to solve the problem pointed out above, and therefore, an object of the present invention is to ensure discharge separation in the vertical direction without increasing the number of man-hours in a formation process and without deteriorating ventilation for an exhaust process.

According to the present invention, a height of cross-pattern portions in a mesh-patterned partition is made smaller than that of the other portions. On that account, for example, a partition pattern in a plan view is made a mesh pattern in which vertical patterns are included at inter-row positions in each column aside from vertical patterns for defining columns of a screen. In this case, the partition includes a plurality of first vertical walls having a ribbon-like pattern along columns, a plurality of second vertical walls having a ribbon-like pattern along the columns and a plurality of horizontal walls having a ribbon-like pattern along rows. Each of the first vertical walls is positioned at a boundary between columns, each of the second vertical walls is arranged at a position away from a boundary between columns for each boundary between rows and each of the horizontal walls is positioned at a boundary between rows. In the partition having such a structure, a height of portions where the first vertical wall intersects the horizontal wall and a height of portions where the second vertical wall intersects the horizontal wall are made smaller than a height of the other portions of the partition.

These and other characteristics and objects of the present invention will become more apparent by the following descriptions of preferred embodiments with reference to drawings.

DETAILED DESCRIPTION OF THE PREFERRED EMBODIMENTS

Figure 1:
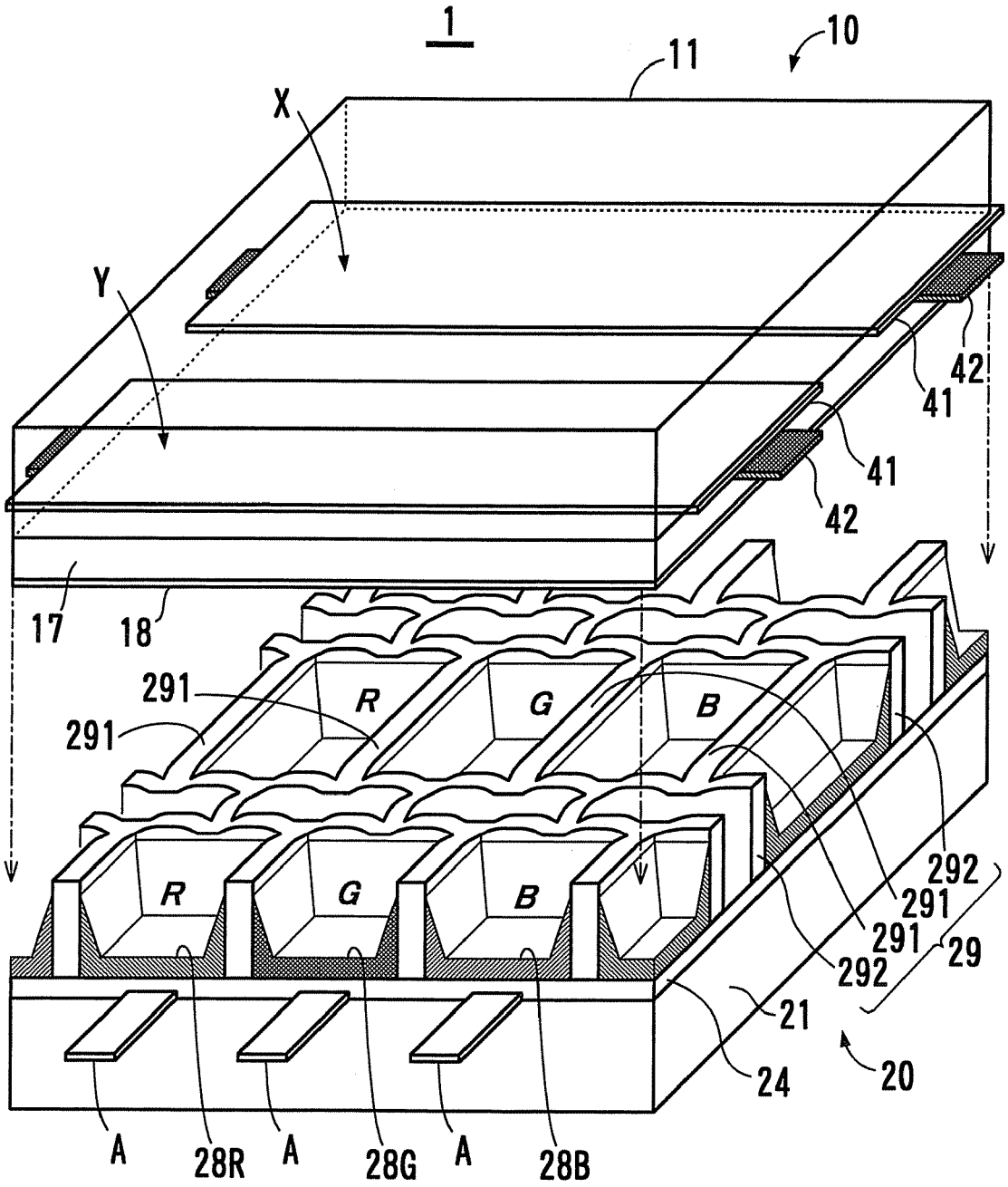
FIG. 1 is a diagram showing a cell structure of a plasma display panel.

FIG. 1 is a diagram showing a cell structure of a plasma display panel. The illustrated plasma display panel 1 is a surface discharge type AC plasma display panel including many cells making up rows and columns of a matrix display. FIG. 1 shows a portion of the plasma display panel 1 with a pair of substrate structures 10 and 20 being detached from each other, the portion corresponding to three cells involved in a display of one pixel, so that the inner structure is seen clearly.

The plasma display panel 1 includes the pair of substrate structures 10 and 20. The substrate structure means a structure including a glass substrate having dimensions equal to or larger than a screen size and at least another type of panel element. The front substrate structure 10 includes a glass substrate 11, display electrodes X and Y, a dielectric layer 17 and a protection film 18. The display electrodes X and Y are covered with the dielectric layer 17 and the protection film 18. The back substrate structure 20 includes a glass substrate 21, address electrodes A, an insulation layer 24, a mesh-patterned partition (discharge barrier) 29 and fluorescent material layers 28R, 28G and 28B. The partition 29 is a structure in which plural portions (vertical walls 291) for defining columns of a screen are integral with plural portions (inter-row portions 292) for defining rows of the screen. The height of the partition 29 is uneven and the upper surface of the partition 29 undulates. The fluorescent material layers 28R, 28G and 28B are excited by ultraviolet rays emitted from a discharge gas so as to emit light. Italic letters R, G and B in FIG. 1 indicate light emission colors (red, green and blue) of the fluorescent materials. The colors are arranged in a repeating pattern of R, G and B in which cells of the same column have the same color.

Figure 2:
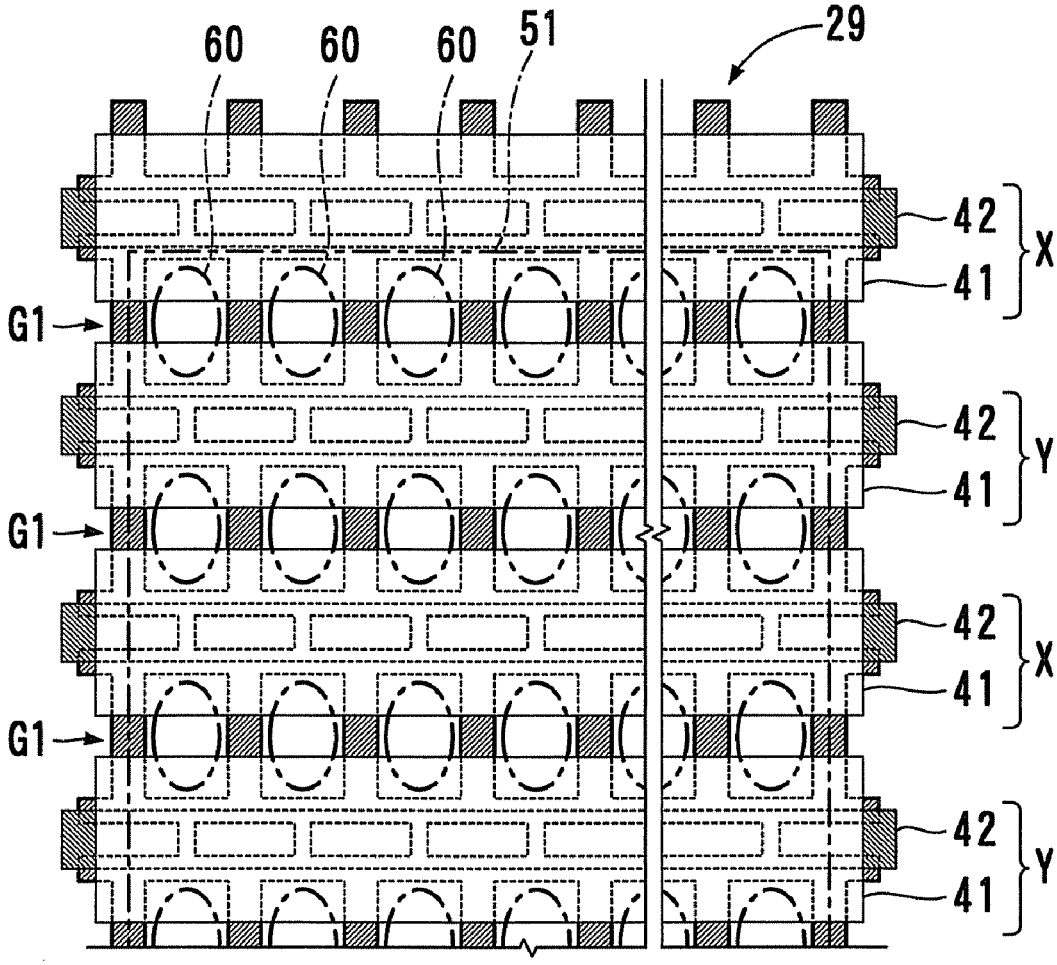
FIG. 2 is a diagram showing an arrangement of display electrodes.

FIG. 2 shows an arrangement of the display electrodes. In the drawing, positions of cells 60 are shown by ellipses drawn by alternate long and short dash lines.

The display electrodes X and Y are arranged at regular intervals at boundaries between rows in a screen 51 in the proportion of one boundary to one electrode. The row is a set of cells 60 arranged in the horizontal direction. Display of one line is performed by one row on the screen 51. Each of the display electrodes X and Y includes a thick ribbon-like transparent conductive film 41 that forms a surface discharge gap G1 and a thin ribbon-like metal film 42 that is a bus conductor for reducing electrical resistance. A set of a display electrode X and a display electrode Y that are adjacent to each other makes an electrode pair (an anode and a cathode) for a surface discharge. Each of the display electrodes X placed at both ends of the arrangement works for a display of one row, while each of the other display electrodes X and Y works for a display of neighboring two rows. The total number of display electrodes X and Y is the number of rows in the screen 51 plus one. In this arrangement form of display electrodes, it is necessary to ensure discharge separation between rows. In addition, the display electrodes Y serve as scan electrodes for row selection in an addressing operation.

Figure 3:
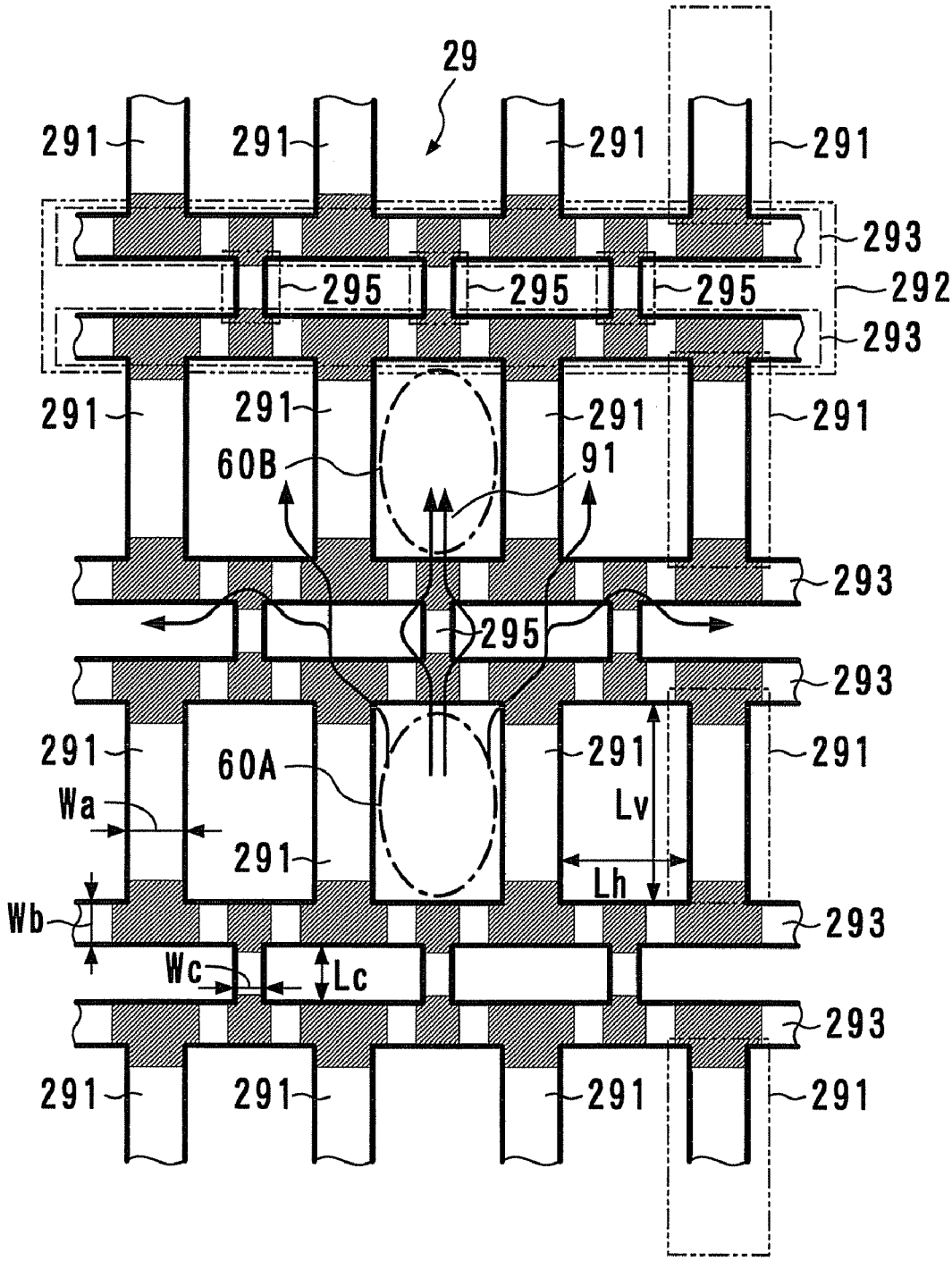
FIG. 3 is a diagram showing a partition pattern.

FIG. 3 shows a partition pattern. The partition 29 is made of a baked material of a low melting point glass. The partition 29 includes a plurality of first vertical walls 291 having a ribbon-like pattern along columns, a plurality of second vertical walls 295 having a ribbon-like pattern along the columns and a plurality of horizontal walls 293 having a ribbon-like pattern along rows. Each of the first vertical walls 291 is positioned at a boundary between columns as a discharge barrier in the row direction, each of the second vertical walls 295, which is an element unique to the present invention, is arranged at a position away from a boundary between columns for each boundary between rows. Each of the horizontal walls 293 is positioned at a boundary between rows. In the partition 29, a pattern in a plan view of the inter-row portion 292 that is a discharge barrier in the column direction is a ladder-like pattern including two of the horizontal walls 293 that extend the entire length of one row and the second vertical walls 295 each of which is provided for each column.

Intersections hatched in FIG. 3, i.e., portions where the first vertical wall 291 crosses the horizontal wall 293 and portions where the second vertical wall 295 crosses the horizontal wall 293 are concave. Stated differently, these intersections have a height lower than the other portions have. The height difference is approximately 5-10 μm. Thus, a gap is provided between the partition 29 and the front substrate structure 10, so that an air path (an exhaust path) 91 is formed in the gap between the substrates of the plasma display panel 1. The air path 91 passes through all the cells and allows for ventilation in the vertical and horizontal directions as denoted by arrows shown in the drawing.

Here, two cells 60A and 60B arranged in the vertical direction are noted. The second vertical wall 295 positioned between the cells 60A and 60B limits the spread of discharge in the vertical direction. The air path 91 is formed so as to detour the second vertical wall 295 and to pass the cells 60A and 60B.

In order to form the partition 29 in which intersections are concave using a partition forming technique described in U.S. Pat. No. 6,608,441, it is necessary to satisfy a condition that ribbon-like patterns crossing each other differ from each other in width. In the present specification, a pattern width relating to the partition is defined as "dimensions at a position where a distance from the top surface is 10% of the height". Concrete dimensions of the partition 29 are as follows.

Length Lv of the first vertical walls 291: 560 μm
Interval Lh between the first vertical walls 291: 240 μm
Width Wa of the first vertical walls 291: 60 μm
Width Wb of the horizontal walls 293: 80 μm
Length Lc of the second vertical walls 295: 180 μm
Width Wc of the second vertical walls 295: 60 μm The exemplified values meet a condition of Wa≠Wb and a condition of Wb≠Wc.

The thermal expansion coefficient of partition materials is the range between $73\times10^{-7}$/° C. and $77\times10^{-7}$/° C. in a typical example. Composition of the partition materials in a typical example is shown in Table 1.

TABLE 1

| COMPONENT | CONTENT [WT %] |
|---|---|
| PbO | 50-70 |
| $B_2O_3$ | 5-10 |
| $SiO_2$ | 10-30 |
| $Al_2O_3$ | 15-25 |
| CaO | 0-5 |

The process for forming the partition 29 is as follows.

(1) On the insulation layer 24 is formed a partition material layer that has a thickness of approximately 200 μm and is made of a uniform paste mixture of a low melting point glass powder having the components specified in Table 1 and a vehicle. The partition material layer may be formed by any method such as a screen-printing method, a laminating method in which a green sheet is transferred or other method.

(2) After drying the partition material layer, a photosensitive dry film is stuck thereto (or a resist material is applied thereto). Then, photolithography including exposure and development is used for forming a cut mask of a mesh pattern corresponding to the partition 29. The mask pattern dimensions are set to values larger than desired partition dimensions in consideration of the heat shrinkage amount.

(3) A sandblasting method is used for grinding a non-masked portion of the partition material layer until the insulation layer 24 is exposed (The partition material layer is patterned).

(4) Heat treatment according to the predetermined temperature profile is performed to bake the partition material layer, so that the partition 29 having a height of approximately 100-150 μm (130 μm, for example) is formed.

Figure 4:
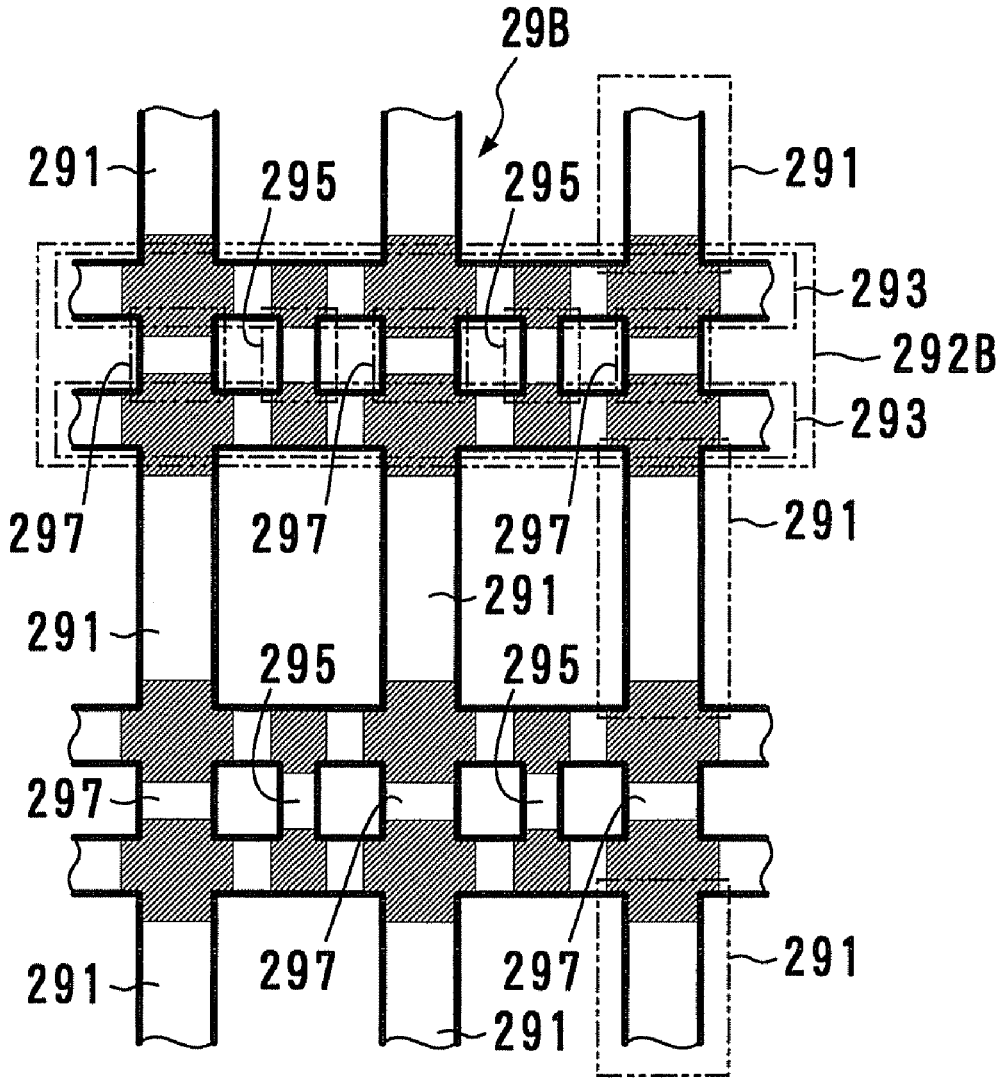
FIG. 4 is a diagram showing a variation of the partition pattern.

FIG. 4 shows a variation of the partition pattern. The basic structure of a partition 29B is similar to that of the partition 29 discussed above. In the illustrated partition 29B, an inter-row portion 292B includes third vertical walls 297. Each of the third vertical walls 297 has the same width as the first vertical wall 291 and is positioned at a boundary between columns. More specifically, a pattern in a plan view of the partition 29B is a mesh pattern including vertical ribbon patterns that have the first vertical walls 291 and the third vertical walls 297 and extends over the entire length of the column. The third vertical walls 297 prevent materials of fluorescent substances to be arranged at columns from protruding to the next columns at inter-row portions when forming fluorescent material layers, which eliminates the possibility of unwanted color mixture.

Figure 5:
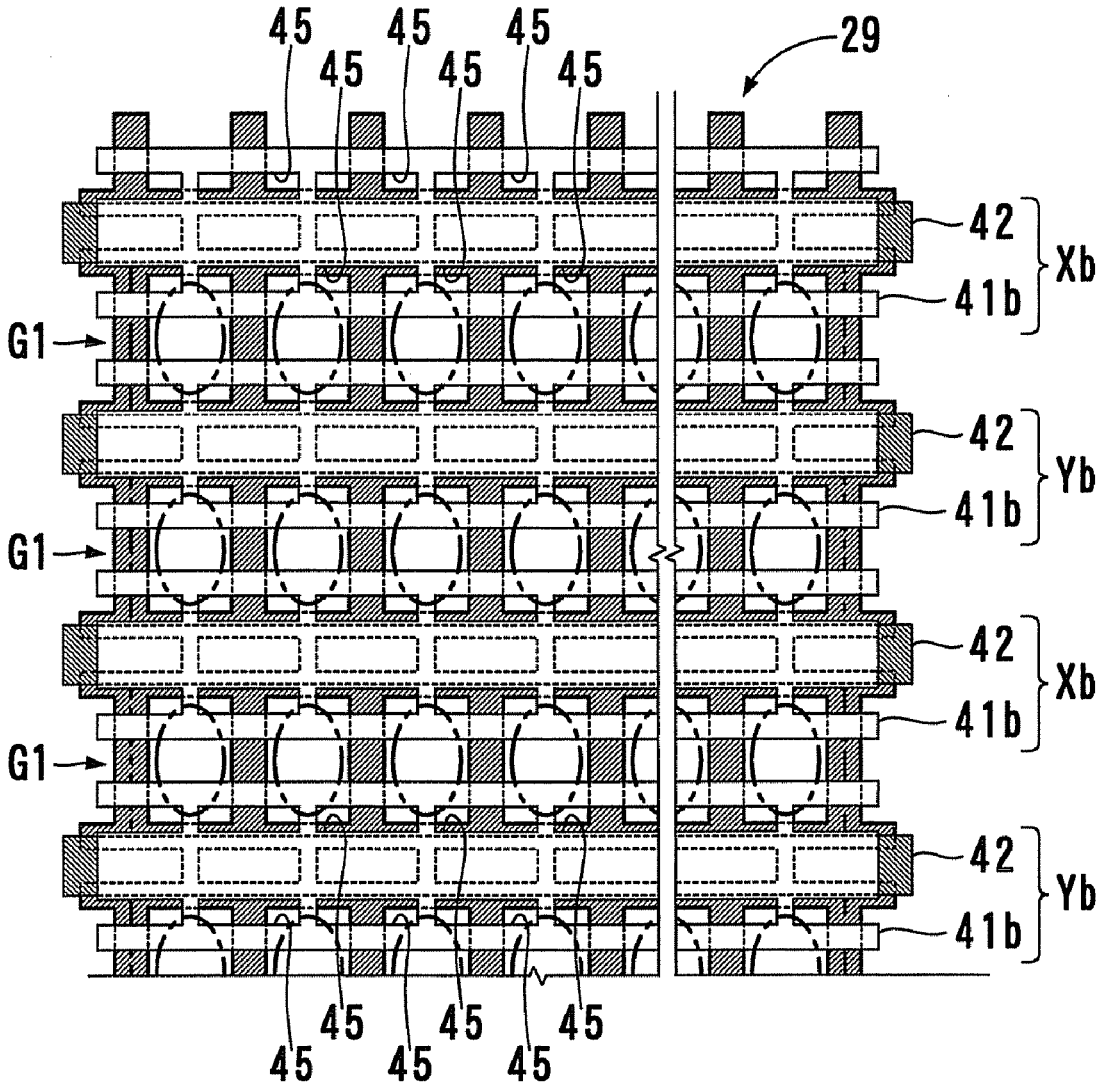
FIG. 5 is a diagram showing a variation of the shape of the display electrodes.

FIG. 5 is a diagram showing a variation of the shape of the display electrodes. In the drawing, positions of cells are shown by ellipses drawn by alternate long and short dash lines.

Each of display electrodes Xb and Yb shown in FIG. 5 includes a thick ribbon-like transparent conductive film 41*b* and a thin ribbon-like metal film 42. The arrangement form of the display electrodes Xb and Yb is similar to the case shown in FIG. 2. Each of the transparent conductive films 41*b* in this example is an axisymmetric ribbon-like film that has a constant width over the entire length of one row and has plural quadrangular holes 45 at both sides of a portion overlapping the metal film 42, the holes being arranged at regular intervals along the metal film 42. Each of the holes 45 has a size enough to partially overlap the horizontal wall 292. Two division portions provided by dividing each of the display electrodes Xb and Yb into two portions in the vertical direction, i.e., portions involved in a display of one row are ladder-like including two horizontal ribbon patterns and plural vertical ribbon patterns for coupling the horizontal ribbon patterns to each other at the center of each column.

The display electrodes Xb and Yb have the holes 45, that is, the display electrodes Xb and Yb are electrodes from which ribbon shapes having a constant width are cut. Thereby, inter-electrode capacitance between the display electrodes and the address electrodes is reduced and discharge currents are reduced. Further, when the display electrodes Xb and Yb are combined with the mesh-patterned partition 29, the vertical ribbon patterns of the ladder-like electrodes and the second vertical walls 295 (see FIGS. 3 and 4) of the partition 29 overlap with each other. Thereby, discharge connections in the vertical direction hardly occur compared to the display electrodes having a straight pattern as shown in FIG. 2.

Figure 6A:
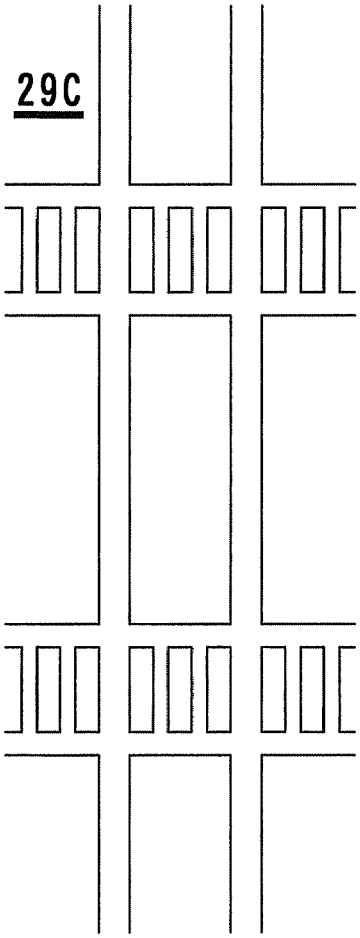
FIGS. 6A-6C are diagrams showing variations of the partition pattern.
Figure 6B:
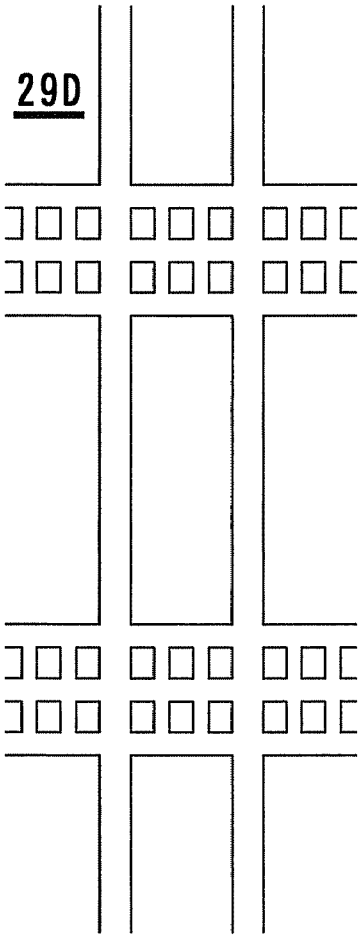
Figure 6C:
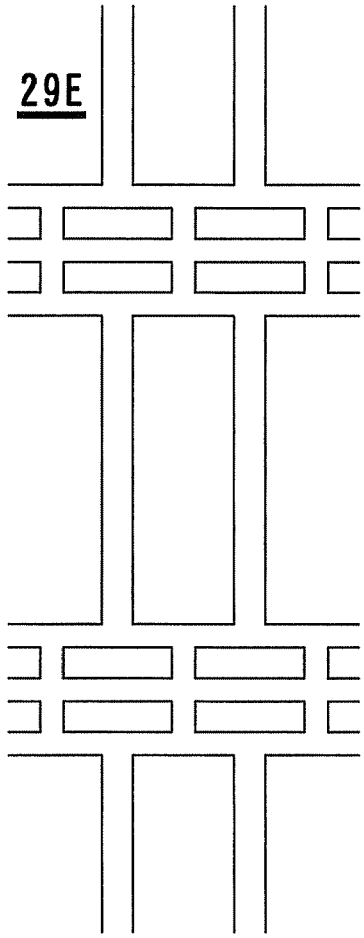

In the examples mentioned above, two or more of the second vertical walls 295 that contribute to separation of discharges in the vertical direction can be positioned at each inter-row portion of each column as shown in partitions 29C and 29D illustrated in FIGS. 6A and 6B, respectively. Further, the inter-row portions 292 and 292B of the partitions 29 and 29B respectively may be structured by three or more horizontal walls and second vertical walls for interconnecting the horizontal walls as shown in partitions 29D and 29E illustrated in FIGS. 6B and 6C, respectively. As the number of second vertical walls 295 is greater, discharges are separated more reliably. However, even in the case of a simple mesh-patterned partition in which the second vertical walls 295 are omitted, cross-pattern portions are lowered. Thereby, ventilation is ensured and separability of discharges in the column direction is ensured at horizontal walls in which central portions of columns in the row direction are higher than end portions. When it is difficult to produce a large height difference, such as a case where a material has a low heat shrinkage rate, it is desirable to increase the ratio of cross-pattern portions in the partition pattern in order to enhance ventilation.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A plasma display panel, comprising:

a mesh-patterned partition having a plurality of discharge barrier portions dividing a discharge space into columns of discharge cells and a plurality of inter-row portions dividing the discharge space into rows of the discharge cells, wherein:

each of the inter-row portions of the mesh-patterned partition is a ladder-like pattern including at least two horizontal walls along a row direction and a plurality of inter-row vertical walls disposed between the horizontal walls;

the inter-row vertical wall crosses the horizontal wall at a position away from a cross section of the discharge barrier portion and the horizontal wall;

a height of the inter-row vertical wall varies in a column direction; and a height of a portion in which the inter-row vertical wall crosses the horizontal wall is lower than a height of an other portion of the inter-row vertical wall.

2. The plasma display panel according to claim 1, wherein the inter-row vertical wall crosses, at one end portion thereof in the column direction, the horizontal wall, and a height midpoint between said one end portion and an other end portion of the inter-row vertical wall is higher than heights of said one end portion and said other end portion.

3. The plasma display panel according to claim 1, wherein the other portion of the inter-row vertical wall has a height with which to limit spread of discharge between the discharge cells adjacent in the column direction to each other.

4. The plasma display panel according to claim 1, wherein a height of the horizontal wall varies in a row direction.

5. The plasma display panel according to claim 4, wherein the height of the horizontal wall in the portion in which the inter-row vertical wall crosses the horizontal wall is lower than the height of the horizontal wall in other portion.

6. The plasma display panel according to claim 4, wherein the height of the horizontal wall in a portion in which the discharge barrier portion crosses the horizontal wall is lower than the height of the horizontal wall in other portion.

* * * * *